US007335042B2

(12) United States Patent
Chirumbolo

(10) Patent No.: US 7,335,042 B2
(45) Date of Patent: Feb. 26, 2008

(54) SUPPLY AND CONTROL DEVICE FOR AN ELECTRIC APPLIANCE HAVING A FLUID-TIGHT TERMINAL WITH PIN CONTACTS, IN PARTICULAR A MOTOR FOR A COMPRESSOR OF A HOUSEHOLD APPLIANCE

(75) Inventor: Dino Chirumbolo, Settimo Torinese (IT)

(73) Assignee: ITW Industrial Components S.R.L. Con Unico Socio, Milan (IT)

( * ) Notice: Subject to any disclaimer, the term of this patent is extended or adjusted under 35 U.S.C. 154(b) by 0 days.

(21) Appl. No.: 11/733,639

(22) Filed: Apr. 10, 2007

(65) Prior Publication Data

US 2007/0237659 A1 Oct. 11, 2007

(30) Foreign Application Priority Data

Apr. 11, 2006 (IT) ..... TO2006A0266

(51) Int. Cl.
*H01R 13/52* (2006.01)

(52) U.S. Cl. ..... 439/282; 439/278; 439/685

(58) Field of Classification Search ..... 439/278, 439/282, 685

See application file for complete search history.

(56) References Cited

U.S. PATENT DOCUMENTS

| | | | |
|---|---|---|---|
| 5,173,057 A | 12/1992 | Bunch et al. | |
| 5,584,716 A | 12/1996 | Bergman | |
| 5,664,959 A | 9/1997 | Duell et al. | |
| 6,372,993 B1 * | 4/2002 | Eckels et al. | 439/282 |
| 6,910,904 B2 * | 6/2005 | Herrick et al. | 439/685 |

FOREIGN PATENT DOCUMENTS

| | | |
|---|---|---|
| EP | 0779681 A1 | 6/1997 |
| EP | 1622228 A | 2/2006 |
| FR | 1164734 A | 10/1958 |

OTHER PUBLICATIONS

EP Search Report dated Jul. 2, 2007 for EP 07 10 5993.
EP Search Report dated Sep. 14, 2007 for EP 07 10 5993.

* cited by examiner

*Primary Examiner*—Tho D. Ta

(57) ABSTRACT

A supply and control device of an electric appliance equipped with a fluid-tight terminal with pin contacts, typically a compressor, including a cup-shaped support formed by electrically non-conductive material, a plurality of electric contacts of the blade type accommodated within the cup-shaped support and presenting same protruding ends facing towards a same open side of the cup-shaped support, arranged in use at an angle with respect to the fluid-tight terminal, at least one wire clamping device integral with the cup-shaped support in a position immediately adjacent to its open side and a housing for a control device arranged within the cup-shaped support, adjacent to the blade contacts and accessible only through an opening obtained through a bottom wall of the cup-shaped support facing in use towards the fluid-tight terminal; the bottom wall being further provided with corresponding holes adapted to throughly receive, in use, the pin contacts and with first mechanical coupling members mating with second mechanical coupling members secured in use to and integral with the fluid-tight terminal; a snappingly couplable lid with the cup-shaped support being contemplated to close in use a mouth of the cup-shaped support facing and opposite the bottom wall.

18 Claims, 3 Drawing Sheets

SUPPLY AND CONTROL DEVICE FOR AN ELECTRIC APPLIANCE HAVING A FLUID-TIGHT TERMINAL WITH PIN CONTACTS, IN PARTICULAR A MOTOR FOR A COMPRESSOR OF A HOUSEHOLD APPLIANCE

The present invention relates to a supply and control device of an electric apparatus equipped with a fluid-tight terminal with pin contacts of the Fusite® type, in particular a motor for a compressor of a refrigerating system of a household appliance, e.g. a refrigerator or freezer.

BACKGROUND OF THE INVENTION

It is known that, in the aforesaid application, the armature of the compressor is provided with a bracket surrounding the fluid-tight terminal, known as "Fusite shield". There are fastened to the bracket in various manners a terminal board for electrically supplying the compressor and various other utilities of the household appliance (lights, thermostat, etc.), which terminal board may be provided with a lid or not, a wire clamp device for securing the electric supply wire of the household appliance, and various control devices, such as for example a starter and/or a thermal protector.

The above-described known solution presents a number of drawbacks: it is generally bulky and relatively costly to manufacture and, above all, to assemble; furthermore, different terminal boards are used according to the different compressors in use and, above all, to the motor protector devices and/or starter devices required for the compressor. Also, specific wires and/or connections are used for connecting the compressor armature to ground.

SUMMARY OF THE INVENTION

It is an object of the present invention to overcome the described drawbacks by providing an integrated supply and control device for an electric appliance, such as a compressor, equipped with a fluid-tight terminal of the type with pin contacts which is simple and cost-effective to manufacture and to mount, which is reliable in time, small in size and which may be preassembled at least in part before assembly.

The present invention thus relates to a supply and control device of an electric apparatus, installable on a Fusite® type fluid-tight terminal as claimed in the attached Claims.

Specifically, the device according to the invention comprises a cup-shaped support formed by electrically non-conductive material, a plurality of electrical contacts of the blade type accommodated within the cup-shaped support and presenting same ends overhangingly arranged towards a same open side of the cup-shaped support, arranged in use at an angle with respect to the fluid-tight terminal, at least one wire clamping device formed integral in one piece with the cup-shaped support in a position immediately adjacent to its open side and a housing for a control device, arranged within the cup-shaped support, adjacent to the blade contacts and accessible only through an opening made through a bottom wall of the cup-shaped support facing the fluid-tight terminal in use; the bottom wall being further provided with corresponding holes adapted to throughly receive in use the pin contacts and with first mechanical coupling members mating with second mechanical coupling members integrally secured in use to the fluid-tight terminal; a lid snappingly couplable with the cup-shaped support is finally contemplated to close in use a mouth of the cup-shaped support facing and opposite to the bottom wall.

The bottom wall of the cup-shaped support is integrally provided, on the side of the mouth of the cup-shaped support, with a plurality of positioning and fastening members for the blade contacts; the housing for the first control device, in the case in point consisting of a thermal protector, consists of the concavity of an embossment or chamber integrally formed in one piece with the bottom wall of the cup-shaped support, and which embossment is overhangingly projecting within the concavity of the cup-shaped support; it thus displays its concavity facing, in use, the fluid-tight terminal; by means of through perforations through the bottom wall, corresponding male faston contacts of the thermal protector are thus connected to selected blade contacts accommodated within the cup-shaped support, which selected blade contacts are transversally provided, in suitable position, with female faston contacts.

The first mechanical coupling members are defined by a number of through perforations of prismatic shape, obtained through the bottom wall of the support, one of which accommodates therein a ground contact carried by one of the blade contacts, while the second mechanical coupling members consist of corresponding L-folded fins, one of which is provided with a hole for being fixed to the ground contact by means of a screw, operating through the open side of the cup-shaped support, closed in use by a removable tilting flap. Within the cup-shaped support, there is further space for a seat for at least one second control device, consisting for example of a starter.

In this manner, the blade contacts may be preassembled together with the starter device to form a single assembly mountable by means of a single operation on the cup-shaped support, while the motor protector may be equally supplied either also pre-assembled on the cup-shape support or installed by the user of the device itself (typically household appliance manufacturer) immediately before assembly of the device onto the Fusite®; furthermore, the starter may be equally either of the type with PTC pill or an E-starter (starter with electronic board); furthermore, the connection ends of the blade contacts are all arranged in a same side position, at the open side of the cup-shaped support, side which may be easily shaped to define a standard multiple connector with the contacts, while the ground contact, which is coupled to one of the second mechanical coupling members (L-shaped fins) integrally carried and preferably integral with the Fusite® welded in use to the armature of the compressor, allows to perform the grounding of the latter in a simple and rapid manner.

Above all, the wiring of all the necessary components may be entirely made before the assembly of the device of the invention on the compressor and such assembly may be performed automatically, requiring a single translation movement to ensure, in single sweep, the electrical and mechanical connection of the device to the fluid-tight terminal (Fusite®); subsequently, through the flap, the grounding contact may be fixed to the corresponding second mechanical coupling member of the Fusite® by means of a screw; this all with extremely small dimensions and a rational arrangement of all the components.

BRIEF DESCRIPTION OF THE DRAWINGS

Further features and advantages of the present invention will be apparent from the following description of a non-limitative embodiment thereof, with reference to the figures of the accompanying drawings, in which.

DETAILED DESCRIPTION OF THE INVENTION

Figure 1:
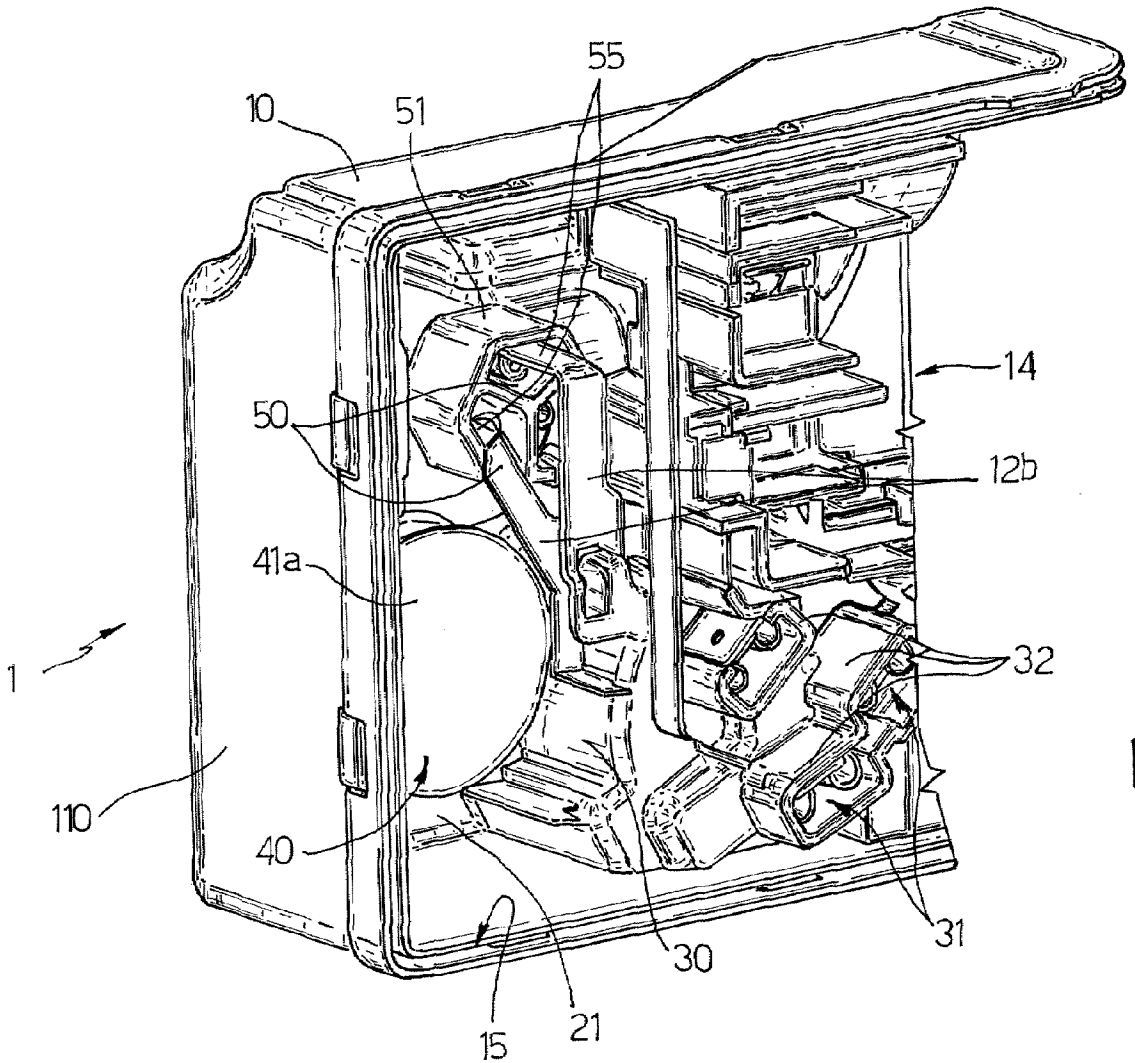
FIG. 1 shows a perspective three-quarters rear view from the left and with parts removed of a supply and control device of a compressor made according to the invention.

With reference to the aforesaid figures, numeral 1 indicates as a whole a supply and control device of an electrical apparatus 2 having a fluid-tight terminal 3 with pin contacts 4. Specifically, electrical apparatus 2 is a compressor (precisely a motor compressor assembly) for household appliances operated in a known manner by electrical windings supplied through pin contacts 4 and fluid-tight terminal 3 is a Fusite®, or of the Fusite® type, integrally carried by a carcass 5 (FIG. 2) of the compressor and comprising a cup-shaped body 7 obtained by coining a metallic plate and a plurality of pin contacts 4 throughly carried by cup-shaped body 7 and at least in part fluid-tightly embedded in a material that is non-conductive, preferably vitreous, and fills the concavity (in a manner not shown for simplicity) of cup-shaped body 7.

Device 1 comprises a cup-shaped support 10 made from electrically non-conductive material within which there are accommodated a plurality of electrical contacts 12 of the blade type, which present same first ends 13 overhangingly arranged facing towards a same open side 14 of cup-shaped support 10, in turn arranged in use at an angle with respect to fluid-tight terminal 3 (in the case in point perpendicular to the laying plane of fluid-tight terminal 3) and with respect to a mouth 15 of cup-shaped support 10 facing in use the side opposite to fluid-tight terminal 3.

Cup-shaped support 10 integrally carries at least one wire clamping device 16 (hereinafter called "wire clamp 16" for the sake of simplicity) of a known type, arranged immediately adjacent to open side 14 and a housing 18 (FIG. 3) for a first control device 19, in the non-limitative case in point consisting of a thermal protector of a known type, for the motor of compressor 2.

Housing 18 is arranged within cup-shaped support 10, in a position adjacent to blade contacts 12 but, according to an aspect of the invention, is separate from the rest of the internal volume of cup-shaped support 10 and accessible only through an opening 20 (FIG. 3) obtained through a bottom wall 21 of cup-shaped support 10, provided on the side opposite to mouth 15 and facing mouth 15 itself; again according to the invention, bottom wall 21 is further provided with corresponding through holes 22 (FIG. 3) adapted to throughly receive in use pin contacts 4, and first mechanical coupling members, indicated as a whole by numeral 24 (FIG. 3), shaped to mate with second mechanical coupling members, indicated as a whole by numeral 25, secured in use to and integral with fluid-tight terminal 3, in the manner described below.

Bottom wall 21 of cup-shaped support 10 is integrally provided, on the side of mouth 15, with a plurality of positioning and fastening members 26 (FIG. 2) for blade contacts 12, in the case in point consisting of ribs, ridges and/or seats, which also extend in part onto the internal side walls of the cup-shaped support 10.

Device 1 further comprises a lid 27 formed by electrically non-conductive material and which is snappingly couplable (in a known and however obvious manner for a person skilled in the art and which is therefore not described) with cup-shaped support 10 to close mouth 15 in use; also lid 27 may be provided with ribs 28 or ridges (FIG. 3) to sandwich blade contacts 12 against bottom wall 21, when lid 27 is coupled to cup-shaped support 10.

According to a feature of the invention, housing 18 for thermal protector 19 consists of the concavity of an embossment 30 provided integrally in one piece with bottom wall 21 so as to overhangingly project within the concavity of cup-shaped support 10 and to present, as a consequence, its concavity (i.e. housing 18) facing in use fluid-tight terminal 3, aligned with opening 20.

Embossment 30 is provided with through perforations 31 (preferably delimited towards the inside of cup-shaped support 10 by corresponding collars 32—FIG. 1) adapted to accommodate in use respective male faston contacts 33 of the thermal protector, when this is accommodated within housing 18, and corresponding contacts 12*a*, selected among the blade contacts 12 accommodated within the cup-shaped support 10, are transversally provided with female faston contacts 34 in a position so as to couple in use with the male faston connectors 33 within the cup-shaped support 10.

Housing 18 may be preferably provided with snapping coupling means 35 (FIG. 3), for example consisting of elastically deformable fins or arms, possibly toothed, provided near the edges of opening 20, to perform a locking retention, if required, of control device 19 within housing 18. In all cases, the latter is shaped so as to allow the assembly of thermal protector 19 only from the exterior of cup-shaped support 10, specifically acting on a side opposite to mouth 15.

Cup-shaped support 10 is shaped so as to define therein, sideways of housing 18 and in a position adjacent to blade contacts 12, between the latter and lid 27, a seat 40 for a second control device 41, in the case in point consisting of a starter; specifically, seat 40 is dimensioned (and shaped) so as to be adapted to indifferently accommodate either a starter 41*a* of the PTC pill type or a starter 41*b* of the electronic board type (known as E-starter).

According to a further aspect of the invention, bottom wall 21 integrally in one piece carries, within the concavity defined by cup-shaped support 10 and at reception holes 22 of pin contacts 4 of fluid-tight terminal 3, corresponding seats 50 (FIG. 1) made within a collar ridge 51 extending within cup-shaped support 10, and intended to accommodate therein, in use, second ends 55 of a selected number 12*b* of blade contacts 12, ends 55 being opposite to ends 13 and shaped so as to be adapted to mechanically and electrically couple with pin contacts 4 through holes 22.

Figures 3, 4:
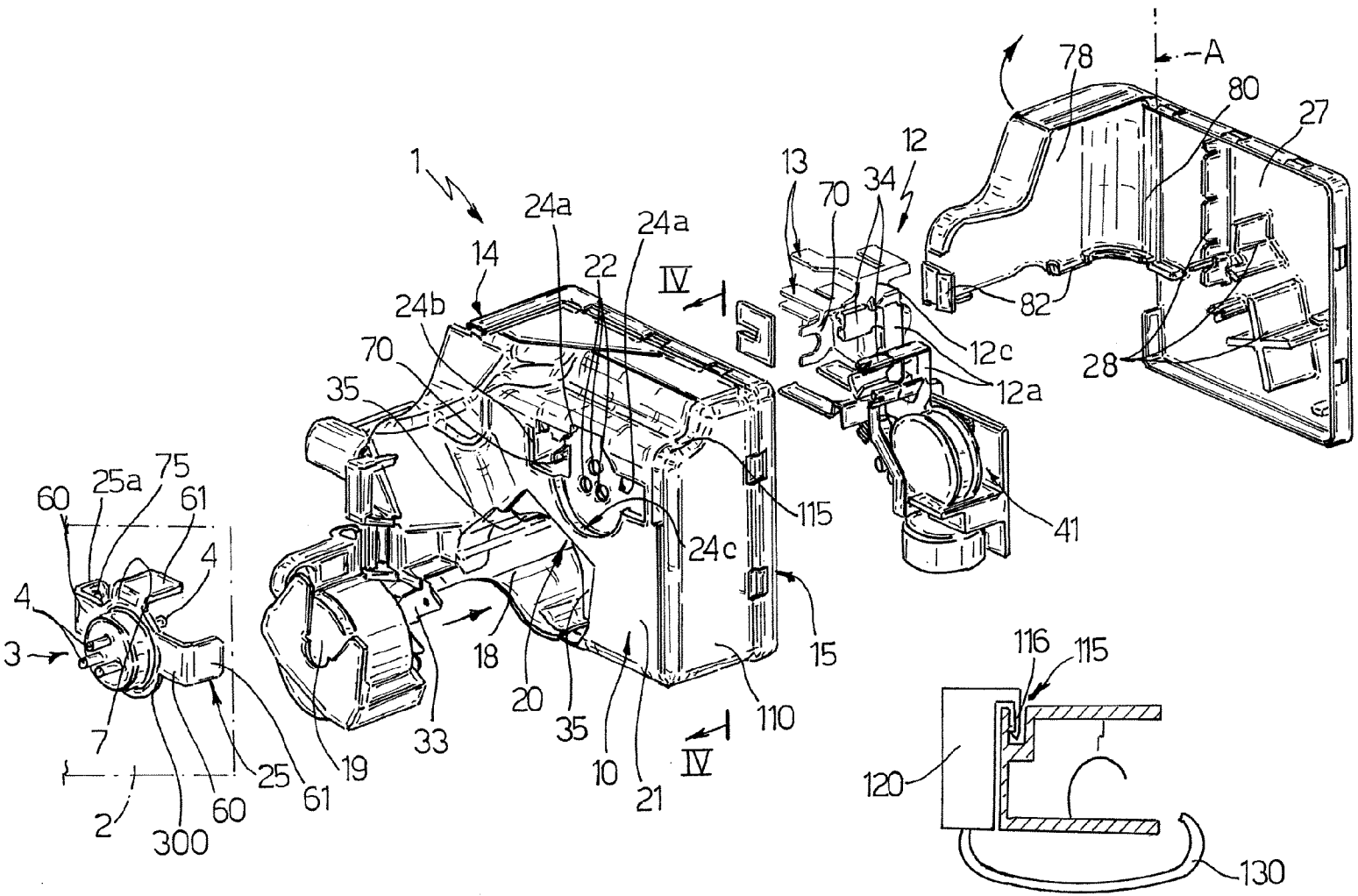
FIG. 3 shows an exploded perspective three-quarters rear view from the right of the device in FIG. 1.
FIG. 4 is a diagrammatic elevation view partially in section taken along a section plane having trace IV-IV, of a detail in FIG. 3.

According to the preferred embodiment shown, first mechanical coupling members 24 comprise one or more through perforations 24*a*,2*b* having prismatic shape and a shallow base 24*c* made through/on the bottom wall 21 peripherically around holes 22, while second mechanical coupling members 25, intended to be in use integrally secured to fluid-tight terminal 3 according to one of the main aspects of the invention, consist in one or more L-folded fins which peripherally and protrudingly extend from fluid-tight contact 3, radially with their first, root portions 60 and axially with their second, end portion 61 (FIG. 3).

Possibly, the first and the second mechanical coupling members 24 and 25 may include mating snappingly fastening means of any known type and not shown for the sake of simplicity.

In all cases, however, perforation 24*b* accommodates therein a second end 70 (opposite to corresponding end 13) of a selected blade contact 12*c* (shown by a phantom line in FIG. 3 in exploded position and by a solid line in working position, positioned within opening 24*b*). End 70 is shaped so as to form a ground contact of the known type for the entire terminal board defined by cup-shaped support 10 and contacts 12.

In combination with this feature, a fin 25*a* of fluid-tight terminal 3, intended to couple in use with opening 24*b* due to its selected positioning, is provided with securing means 75 to the ground contact 70 consisting of a hole adapted to throughly receive, in use, a fastening screw (not shown) to ground contact 70, in the case in point through open side 14 of cup-shaped support 10.

To close said open side 14 in use, device 1 finally comprises a removable closing flap 78 for side 14 integrally and tiltingly carried in use by cup-shaped support 10, in particular integrally made with lid 27, to which it is connected by means of an either elastically or plastically deformable thinned portion 80, defining a "plastic" hinge having a rotation axis A (FIG. 3). In this manner, flap 78, besides being provided with snapping fastening means 82 against the edge of open side 14 (FIG. 3), defined for example by one or more elasticised teeth, may be coplanarly moulded with lid 27, formed by the same plastic material as the latter (synthetic plastic resin) in a single injection operation.

Figure 2:
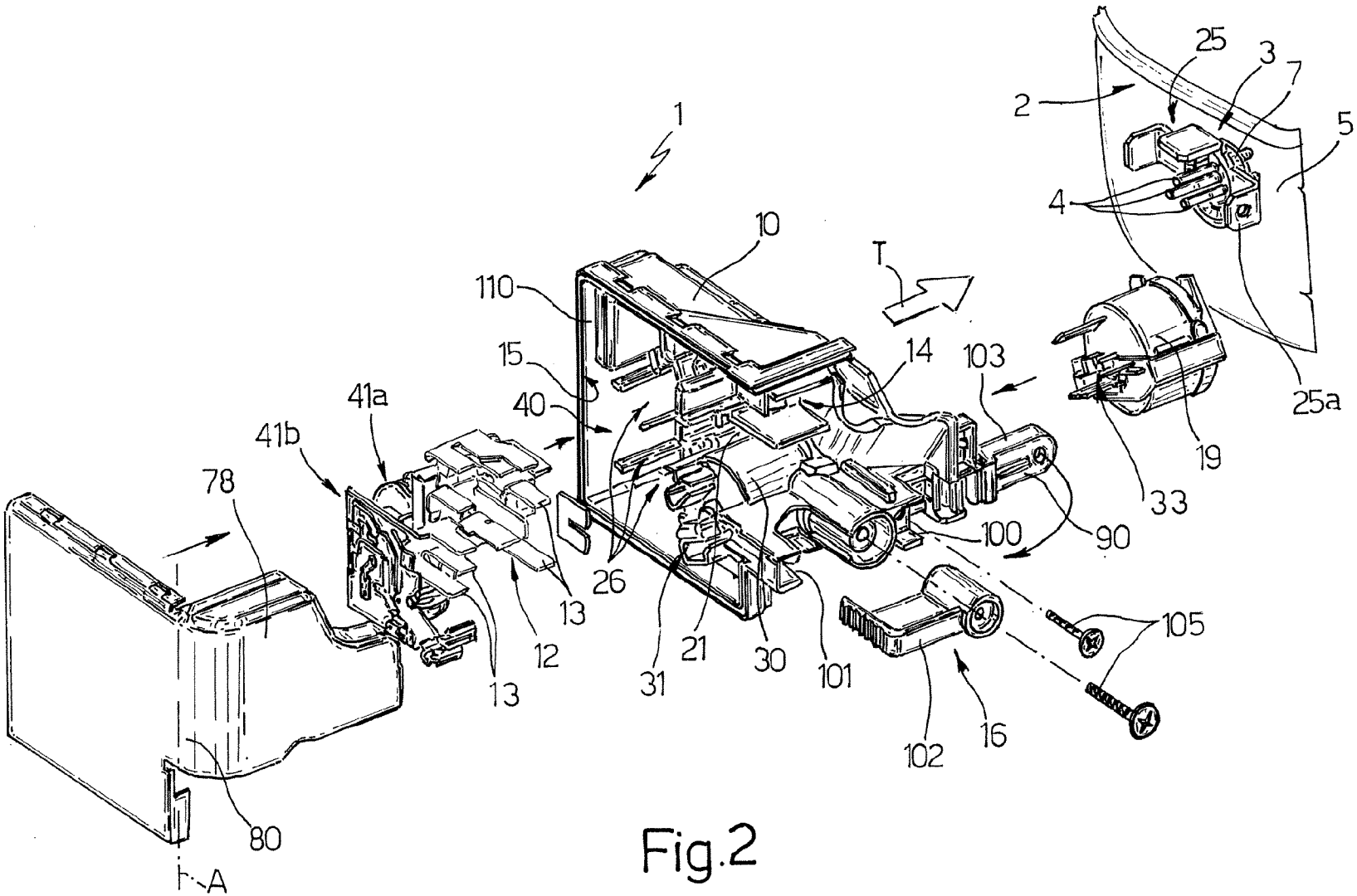
FIG. 2 shows an exploded perspective thrquarters front view of the device in FIG. 1.

Wire clamp 16 is integrally obtained with cup-shaped support 10, preferably side by side to a second wire clamp 90, of a different type yet otherwise known, as wire clamp 16 is also of the known type. Both consist in seats 100,101 for the passage of the wires to be clamped, and in precision members 102,103 integrally connected, again by means of deformable members, to the edge of open side 14 and fastenable in seats 100,101 by means of screws 105 (FIG. 2).

Cup-shaped support 10 is finally provided, at a side wall 110 thereof opposite to open side 14, with snapping fastening means for an electric member, preferably a power factor correction condenser 120; such snapping fastening means consist in a slot 115 engageable in use by a tooth 116 (FIG. 4) of condenser 120, which is thus easily connectable with one of the blade contacts 12, for example by means of a wire 130.

The preferred embodiment of the invention contemplates that fins 25 are integrally obtained in one piece with the Fusite®, so as to allow considerable assembly economy. Specifically, cup-shaped body 7 of fluid-tight terminal 3 presents an edge 300 which delimits the mouth of its concavity and which is arranged in use on the outside of carcass 5, for example projection-welded onto the same. Edge 300 is peripherally and overhangingly provided with a plurality of L-folded fins 25, in the case in point three fins arranged in a cross, reciprocally spaced out with a circumferential interval of 90°, a first, root portion 60 of which radially and overhangingly extends from edge 300, and ae second, terminal portion 61 of which, immediately adjacent to first portion 60, axially and overhangingly extends from first portion 60, parallelly to pin contacts 4; a fin 25*a* of such a type of modified Fusite® further presents a through hole 75 adapted to receive a fastening screw (not shown) to allow the mechanical fastening thereof to the above-described ground contact 70 of device 1.

It is apparent from the description that all the objects of the invention are reached. Both device 1 and modified Fusite® 3 display a small size and a great manufacturing and assembly simplicity; they further allow to entirely pre-wire all the electrical connections before mechanical assembly of device 1 onto terminal 3, which being performable in a single translation movement in the direction of arrow T (FIG. 2), may be performed in a totally automatic manner; finally, by means of flap 78 and open side 14 covered thereby, it is easy to proceed with the electric and mechanical coupling of ground contact 70 to body 7 of terminal 3, thus ensuring the defined mechanical fastening of the entire device 1 and the grounding of carcass 5 at the same time.

The invention claimed is:

1. A supply and control device for an electric appliance equipped with a fluid-tight terminal with pin contacts, in particular a compressor, comprising: a cup-shaped support made of electrically non-conductive material; a plurality of electrical contacts of the blade type accommodated within the cup-shaped support and presenting same first ends arranged protrudingly towards a same open side of the cup-shaped support, in turn arranged in use at an angle with respect to the fluid-tight terminal and a mouth of the cup-shaped support facing in use the opposite side of the fluid-tight terminal; at least one wire clamping device integrally carried by the cup-shaped support in position immediately adjacent to its open side; and a housing for a first control device, arranged within the cup-shaped support, adjacent to the blade contacts; characterised in that said housing is accessible only through an opening made through the bottom wall of the cup-shaped support facing the opposite side of said mouth of the same; the bottom wall being further provided with respective holes adapted to receive in use, throughly, the pin contacts and first mechanical coupling members mating with second mechanical coupling members integrally secured in use to said fluid-tight terminal.

2. A device according to claim 1, characterised in that said bottom wall of the cup-shaped support is integrally provided in one piece thereof, on the side of said mouth of said cup-shaped support, with a plurality of positioning and fastening members for said blade contacts.

3. A device according to claim 1, characterised in that said housing for said first control device consists of the concavity of an embossment integrally provided in one piece with said bottom wall of the cup-shaped support, which embossment is protrudingly projecting within the concavity of the cup-shaped support and presents its said concavity facing in use the said fluid-tight terminal; said embossment being provided with through perforations adapted to accommodate in use respective male faston contacts of said first control device; and at least some of said blade contacts housed within the cup-shaped support being transversally provided with female faston contacts so as to in use couple with said male faston connectors.

4. A device according to claim 1, characterised in that said housing is provided with snapping coupling means for said first control device.

5. A device according to claim 1, characterised in that said first control device is a thermal protector; said housing being shaped so as to allow the assembly of the thermal protector only from the exterior of said cup-shaped support, on the side opposite to said mouth.

6. A device according to claim 1, characterised in that it also comprises a lid made of electrically non-conducting material and which is snappingly couplable with the cup-shaped support to close said mouth of the same in use.

7. A device according to claim 6, characterised in that said cup-shaped support is shaped so as to define therein, sideways to said housing for the first control device and in a position adjacent to said blade contacts, between the latter and said lid, a seat for a second control device.

8. A device according to claim 7, characterised in that said second control device is a starter; said seat being dimensioned so as to accommodate either a starter of the type with PTC pill or with electronic board, indifferently.

9. A device according to claim 1, characterised in that said bottom wall integrally carries, within the cup support concavity and at said reception holes of the fluid-tight terminal pin contacts, respective seats for second ends of a selected part of said blade contacts, opposite to the first ends and shaped so as to be adapted to mechanically and electrically couple with pin contacts through said holes.

10. A device according to claim 9, characterised in that said first mechanical coupling members comprise one or more prism-shaped through perforations made through said bottom wall of the cup-shaped support peripherally around said pin contact reception holes.

11. A device according to claim 10, characterised in that said second mechanical coupling members, which are in use integrally secured to the fluid-tight terminal, consist of one of more L-folded fins which peripherally and protrudingly extend from the fluid-tight contact, radially with a first, root portion and axially with a second, end portion thereof.

12. A device according to claim 1, characterised in that said first and second mechanical coupling means include mating snappingly fastening means.

13. A device according to claim 1, characterised in that one of said first mechanical coupling members houses therein a second end of one of said blade contacts, which is shaped so as to form a ground contact; the respective of said second mechanical coupling members, intended to couple in use with said first mechanical coupling member housing said earth contact, being provided with securing means of said ground contact.

14. A device according to claim 13, characterised in that said securing means is a hole adapted to throughly receive a fastening screw to the ground contact through said open side of the cup-shaped support; said device further comprising a removable closing flap of said open side integrally and tiltingly carried in use by the cup-shaped support.

15. A device according to claim 1, characterised in that said fluid-tight terminal is a Fusite®; and in that said at least one wire clamping device is made integral in one piece with said cup-shaped support.

16. A device according to claim 1, characterised in that said cup-shaped support is provided at one of its side walls opposite to said open side with snapping coupling means for an electrical member, preferably a power factor correction condenser connectable with one of said blade contacts carried by the cup-shaped support by means of a wire.

17. A fluid-tight terminal of the Fusite® type, in particular of the type integrally carried by a carcass of a compressor for household appliances, comprising a cup-shaped body made by coining a metallic plate and a plurality of pin contacts throughly carried by the cup-shaped body and at least in part fluid-tightly embedded in a non-conductive, preferably vitreous, material; characterised in that said cup-shaped body presents an edge which delimits in use its mouth and which is arranged in use on the outside of said carcass, which is peripherally and protrudingly provided with a plurality of L-folded fins, whose first, root portion radially protrudes from said edge, and whose second, end portion, immediately next to the first portion, axially and protrudingly extends from said first portion, parallelly to said pin contacts; at least one of said fins presenting a through hole adapted to receive a fastening screw.

18. A fluid-tight terminal according to claim 17, characterised in that it is provided with three of said L-shaped fins, reciprocally arranged at a circumferential interval of 90°.

* * * * *